US007272870B2

(12) United States Patent
Pierce et al.

(10) Patent No.: US 7,272,870 B2
(45) Date of Patent: Sep. 25, 2007

(54) SECONDARY INTRODUCTION OF FLUID INTO VACUUM SYSTEM

(75) Inventors: Paul M. Pierce, Grand Haven, MI (US); Frederick A. Hekman, Holland, MI (US); Jeffrey Oberlin, Fruitport, MI (US)

(73) Assignee: Tennant Company, Minneapolis, MN (US)

( * ) Notice: Subject to any disclaimer, the term of this patent is extended or adjusted under 35 U.S.C. 154(b) by 418 days.

(21) Appl. No.: 10/841,872

(22) Filed: May 6, 2004

(65) Prior Publication Data

US 2005/0246853 A1 Nov. 10, 2005

(51) Int. Cl.
*A47L 11/30* (2006.01)

(52) U.S. Cl. ..... 15/322; 15/320; 15/383

(58) Field of Classification Search ..... 15/320, 15/321, 322, 302, 383
See application file for complete search history.

(56) References Cited

U.S. PATENT DOCUMENTS

| | | | | |
|---|---|---|---|---|
| 990,775 | A | 4/1911 | Reid | 15/52 |
| 1,268,963 | A | 6/1918 | Gray | 15/320 |
| 2,518,183 | A | 8/1950 | Renne | 15/52 |
| 3,631,558 | A | 1/1972 | Kovacevic | 15/50.3 |
| 3,696,458 | A | 10/1972 | Leifheit et al. | 15/50.3 |
| 3,750,217 | A | 8/1973 | Liebscher | 15/50.3 |
| 3,761,985 | A | 10/1973 | Leifheit | 15/50.3 |
| 3,843,989 | A | 10/1974 | DeMaagd | 15/50.3 |
| 3,875,605 | A | 4/1975 | Fegan | 15/50.3 |
| 3,936,199 | A | 2/1976 | Zimmermann | 401/40 |
| 3,983,592 | A | 10/1976 | Fegan | 15/49.1 |
| 4,245,371 | A | 1/1981 | Satterfield | 15/320 |
| 4,360,946 | A | 11/1982 | Marshall, Jr. et al. | 15/321 |
| 4,369,544 | A | 1/1983 | Parisi | 15/320 |
| 4,433,451 | A | 2/1984 | Parisi | 15/321 |
| 4,570,278 | A | 2/1986 | Bloome et al. | 15/97.1 |
| 4,654,916 | A | 4/1987 | Postonen et al. | 15/50 |
| 4,822,431 | A | 4/1989 | Bricher et al. | 15/320 |
| 4,845,794 | A | 7/1989 | Korski et al. | 15/51 |
| 4,872,920 | A * | 10/1989 | Flynn et al. | 15/320 |
| 4,884,310 | A | 12/1989 | Knestele | 15/3 |
| 4,914,773 | A | 4/1990 | Ham | 15/3 |
| 5,086,539 | A | 2/1992 | Rench | 15/384 |
| 5,203,047 | A | 4/1993 | Lynn | 15/99 |
| 5,241,724 | A | 9/1993 | Lim | 15/322 |
| 5,287,581 | A | 2/1994 | Lo | 15/52 |
| 5,309,597 | A | 5/1994 | Wymore | 15/22.3 |

(Continued)

FOREIGN PATENT DOCUMENTS

| | | |
|---|---|---|
| DE | 6934247 | 8/1969 |

(Continued)

*Primary Examiner*—Theresa T. Snider
(74) *Attorney, Agent, or Firm*—Fulbright & Jaworski LLP

(57) ABSTRACT

An apparatus and method for minimizing the accumulation of soil and debris within a vacuum system of a surface maintenance machine is disclosed. A secondary fluid, such as pressurized cleaning solution, is sprayed into the vacuum system in order to reduce soil and debris accumulation within the vacuum system without applying additional fluid to a floor surface. In one embodiment of the invention, pressurized fluid is introduced directly into the vacuum extractor tool of a surface cleaning machine in order to dislodge accumulated debris on surfaces therein. A method of minimizing the accumulation of soil and debris within the vacuum system is also disclosed. The invention is applicable to a variety of portable and vehicle-based floor cleaning machines.

36 Claims, 10 Drawing Sheets

U.S. PATENT DOCUMENTS

| | | | | |
|---|---|---|---|---|
| 5,371,912 | A | 12/1994 | Hall | 15/98 |
| 5,404,609 | A | 4/1995 | Rench et al. | 15/52.1 |
| 5,465,456 | A | 11/1995 | Fellhauer et al. | 15/320 |
| 5,483,718 | A | 1/1996 | Blehert et al. | 15/50.3 |
| 5,503,594 | A * | 4/1996 | Karubian et al. | 15/321 |
| 5,515,568 | A | 5/1996 | Larson et al. | 15/50.3 |
| 5,640,739 | A * | 6/1997 | Campbell | 15/321 |
| 5,657,504 | A | 8/1997 | Khoury | 15/98 |
| 5,697,119 | A | 12/1997 | Mussalo | 15/320 |
| 5,699,576 | A | 12/1997 | Sohaiby | 15/103 |
| 5,715,565 | A | 2/1998 | Kern | 15/322 |
| 5,797,163 | A | 8/1998 | Whitaker | 15/413 |
| 5,813,086 | A | 9/1998 | Ueno et al. | 15/320 |
| 5,867,861 | A | 2/1999 | Kasen et al. | 15/320 |
| 5,901,410 | A | 5/1999 | Windmeisser | 15/354 |
| 5,933,900 | A | 8/1999 | Wang | 15/50.3 |
| 6,030,465 | A | 2/2000 | Marcussen et al. | 134/6 |
| 6,055,699 | A | 5/2000 | Cho | 15/321 |
| 6,088,873 | A | 7/2000 | Pacchini et al. | 15/320 |
| 6,145,145 | A | 11/2000 | Besel | 15/22.3 |
| 6,662,402 | B2 | 12/2003 | Giddings et al. | 15/320 |
| 6,735,806 | B2 | 5/2004 | Blum et al. | 15/104.002 |
| 6,735,812 | B2 | 5/2004 | Hekman et al. | 15/320 |
| 2006/0037169 | A1 * | 2/2006 | Sanders | 15/302 |

FOREIGN PATENT DOCUMENTS

| | | |
|---|---|---|
| DE | 3616398 | 12/1986 |
| DE | 4117957 | 12/1992 |
| EP | 0286328 | 10/1988 |
| JP | 05123278 | 5/1993 |
| WO | 9749324 | 12/1997 |
| WO | 03/003897 | 1/2003 |

* cited by examiner

SECONDARY INTRODUCTION OF FLUID INTO VACUUM SYSTEM

FIELD OF THE INVENTION

The present invention relates generally to surface maintenance or conditioning machines, and more particularly to those machines employing one or more surface maintenance or conditioning appliances or tools to perform a floor cleaning task.

BACKGROUND OF THE INVENTION

Floor surface cleaners are well known. Soft floor cleaners include carpet cleaning devices. In general, proper carpet maintenance involves regular vacuuming and periodic cleaning to remove soil by methods such as hot water extraction, shampooing, bonnet cleaning, foam cleaning, etc. Some of the soil is loosely found between carpet fibers while other soil is held upon the carpet fibers by some means such as electrostatic forces, van der Waals forces, or oil bonding. Still other soil is mechanically trapped by carpet fibers. Regular vacuuming is essential as it removes some of the loose soil that damages the fibers. Vacuuming maintains the surface appearance of a carpet and keeps the level of soil in the pile at an acceptable level. Vacuuming removes only particulate soil arid some unbound or loosely bound surface dirt, however, therefore, other methods of cleaning are periodically required to improve the appearance of the carpet Wet cleaning methods are required to remove oils, greases, bound dirt, and other forms of matter that cause soiling on carpet These methods are often used by professional cleaners and trained personnel.

One type of surface maintenance machine for carpet cleaning is referred to as a bonnet cleaner. Bonnet cleaners employ an absorbent bonnet or pad (hereinafter referred to as the "pad") attached to a rotary driver for rotating the pad about an axis generally perpendicular to the carpet surface. Most commonly a solution of cleaning liquid is sprayed directly onto the carpet and then the rotating pad is used to agitate the wetted carpet. This action transfers soil from the carpet onto the pad. Since the pad is commonly two-sided, the pad may be reversed once one side of the pad gets saturated or soiled to a selected level. The pad may be periodically replaced and later cleaned depending upon the application and wear characteristics of the pad.

The soil transfer process of the bonnet cleaners may be characterized as a "circular engagement process" since the pad rotates in a circular motion essentially in the plane of the carpet surface. The method employed by bonnet cleaners has the advantage of being fast drying if a relatively small amount of cleaning liquid is employed. However the process is fundamentally unstable since the rotating pad starts out clean and becomes less and less effective as a cleaning tool as it collects soil. Additional limitations of bonnet cleaners include transferring soil from soiled areas to relatively cleaner areas, leaving much of the cleaning fluid in the carpet, and having the potential to damage the carpet. With respect to the latter, some carpets, particular twisted ply variations, may be damaged by aggressive engagement with the rotating pad. Additionally, the bonnet cleaning process is a relatively labor intensive process since the pad requires frequent soil monitoring and frequent removal of soiled pads. Yet another limitation of bonnet cleaners is the relatively uncontrolled use of cleaning liquid in the carpet cleaning process as some areas of the carpet may receive more cleaning liquid spray than other areas. Reliance on operator spraying of cleaning liquid to the carpet surface may result in over wetting of some areas and under wetting of other areas.

Another type of surface maintenance machine designed for carpet cleaning is referred to as a "hot water extractor" or an "extractor machine." Extractor machines are commonly used for deep carpet cleaning. In general, an extractor is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Generally, the extraction process applies a relatively large quantity of cleaning liquid on the carpet. While the vacuum system recovers a portion of the applied cleaning liquid, a significant portion is retained by the carpet. As a consequence, carpet drying times are substantially longer than in the bonnet cleaning process.

Other types of hard floor surface cleaning machines are also known. For example, floor scrubbers and sweeper/scrubber machines are well known devices for cleaning hard floor surfaces.

SUMMARY OF THE INVENTION

The present invention is directed to secondary fluid introduction into a vacuum system of a surface cleaning machine for minimizing debris and soil accumulation during use. The secondary fluid may be introduced into the vacuum extractor via a nozzle or similar device in communication with the interior of the extractor. In one embodiment of the present invention, the secondary fluid is water which is injected into the vacuum extractor of a soil transfer machine, such as disclosed in U.S. Pat. No. 6,662,402. In other embodiments of the present invention, the secondary fluid is sprayed into the vacuum extractor tool of known floor surface cleaning devices.

The addition of a secondary fluid in the vacuum system minimizes the tendency for debris and soil accumulation within the vacuum system. The secondary fluid may be water or another fluid such as a cleaning solution or even recycled cleaning solution. The secondary fluid may be continuously or intermittently introduced into the vacuum extractor. The introduction of the secondary fluid may be controlled via the electronic control system of the machine. The secondary fluid may be pressurized by a pump or may be gravity fed into the vacuum extractor.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
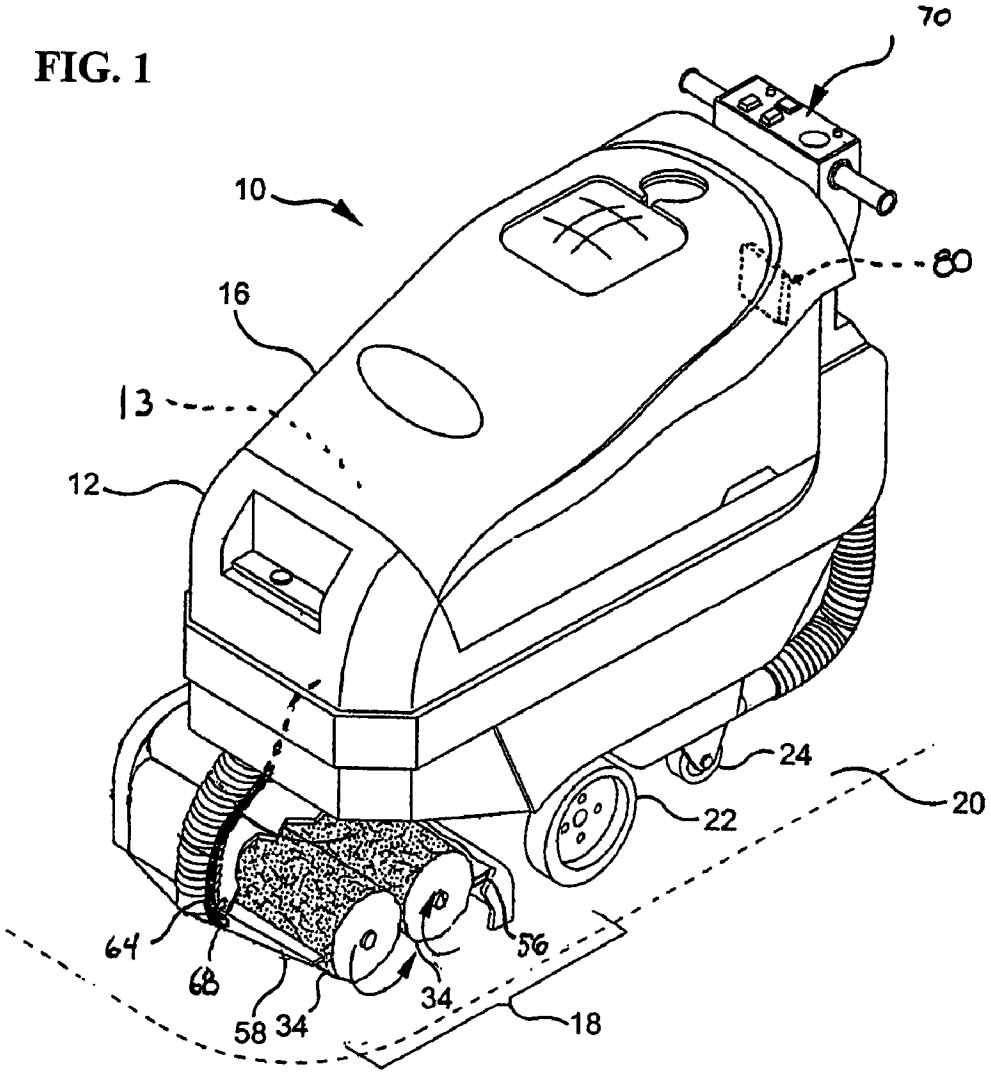
FIG. 1 is a perspective illustration of one embodiment of a cleaning machine according to the present invention.

The present invention is directed both to a method and an apparatus for introducing a secondary fluid into a vacuum system of a floor surface maintenance machine in order to minimize debris and soil accumulation within the vacuum extractor and other vacuum system components. In a broad sense as will subsequently be described, the method and apparatus in accordance with the present invention may find wide applicability across a variety of surface maintenance machines.

A method and apparatus according to the present invention may find application in devices disclosed in commonly assigned U.S. patent application Ser. No. 10/705,570 entitled "Method and Apparatus for Cleaning Fabrics, Floor Coverings, and Bare Floor Surfaces Utilizing a Soil Transfer Cleaning Medium," Ser. No. 10/371,940 entitled "Dual Mode Carpet Cleaning Apparatus Utilizing an Extraction Device and a Soil Transfer Cleaning Medium," Ser. No. 10/081,374 entitled "Method and Apparatus for Cleaning Fabrics, Floor Coverings, and Bare Floor Surfaces Utilizing a Soil Transfer Cleaning Medium," now U.S. Pat. No. 6,662,402, Ser. No. 10/236,746, entitled "Low Profile Head," Ser. No. 10/177,365 entitled "Squeegee with Clog Reduction Structure," and Ser. No. 10/328,516, entitled "Hard Floor Surface Cleaner Utilizing an Aerated Cleaning Liquid," now U.S. Pat. No. 6,705,332, the disclosures of which are hereby incorporated herein by reference in their entirety.

A surface maintenance machine for carpet cleaning has been developed by Tennant Company and is the subject of U.S. Pat. No. 6,662,402, entitled "Apparatus and Method for Cleaning Fabrics, Floor Coverings, and Bare Floor Surfaces Utilizing a Soil Transfer Cleaning Medium", U.S. Ser. No. 10/705,570, entitled "Apparatus and Method for Cleaning Fabrics, Floor Coverings, and Bare Floor Surfaces Utilizing a Soil Transfer Cleaning Medium," and U.S. Ser. No. 10/371,940, entitled "Dual Mode Carpet Cleaning Apparatus Utilizing an Extraction Device and a Soil Transfer Cleaning Medium," each of these being incorporated in their entireties by reference herein. These references disclose a soil transfer method for cleaning a carpet surface. In disclosed devices, cleaning solution is sprayed directly onto a revolving cleaning medium instead of the surface being cleaned. In accordance with those inventions, a revolving cleaning medium, such as a cylindrical roll, is wetted and wiped against a surface intended to be cleaned. In general, this method of cleaning includes the steps of (i) wetting a revolving cleaning medium with a cleaning solution, (ii) removing at least some of the cleaning liquid from the revolving cleaning medium directly after wetting by way of a vacuum extraction device, and (iii) wiping the surface with the revolving cleaning medium so as to transfer soil from the surface to the revolving cleaning medium and subsequently removing transferred soil from the revolving cleaning medium.

A significant advantage of the soil transfer cleaning method is the minimization of water use as a substantially smaller amount of cleaning solution is applied to the carpet surface. The benefits of reduced cleaning solution usage are 3-fold. First, reduced solution usage lowers the cost of operation since it requires less clean water and less cleaning chemical to clean a given area and it produces less waste water to be disposed of after cleaning. Second, reduced solution usage increases productivity since the cleaning equipment can be operated for longer periods of time without stopping to refill or empty the solution tanks. Third, reduced solution usage results in a significantly shorter dry time after the cleaning process has been completed and before the area can be reopened for use. However, one of the limitations of water economy in such machines has been the tendency for soil and debris to accumulate upon inner surfaces of the vacuum extractor. Accumulated debris and soil can lead to partial clogging of the vacuum extractor resulting in a less efficient recovery of soiled solution from the revolving cleaning medium. Additional machine maintenance has been required to unclog the vacuum extractor of machines using the soil transfer method of cleaning.

An apparatus and method of use for minimizing the tendency of debris and soil accumulation within a vacuum extractor of a soil transfer cleaning machine would be desirable. One potential approach would be to increase the amount of cleaning solution dispensed upon the cleaning medium and/or carpet surface during the cleaning process so that additional water is intersperse with the debris and soil. However, this would counteract the benefits of low water use and quick drying times of the soil transfer technology. A need therefore exist for minimizing the tendency of debris and soil accumulation within a vacuum extractor during a cleaning process.

FIG. 1 illustrates an embodiment of a transportable floor surface cleaning machine 10 incorporating aspects of the present invention. More particularly, machine 10, for illustrative purposes, is a battery-powered walk-behind machine similar to those known in the art, including a first solution tank 12 for containing a cleaning liquid 14, such as a mixture of water and a cleaning chemical, a second solution tank 13 for containing a liquid, such as water and/or a cleaning solution, a recovery tank 16, a cleaning head 18, a cleaning liquid dispensing system, and a soiled solution extraction system as further described herein. In one embodiment of the invention, cleaning fluid 14 is water without detergent.

Machine 10 is supported upon the ground surface 20 by drive wheels 22 and caster wheels 24. Cleaning head 18 is attached at a forward portion of the machine 10 via a positioning actuator (not shown). In alternative embodiments of the invention, cleaning head 18 may be attached at other portions of a machine.

Figure 2:
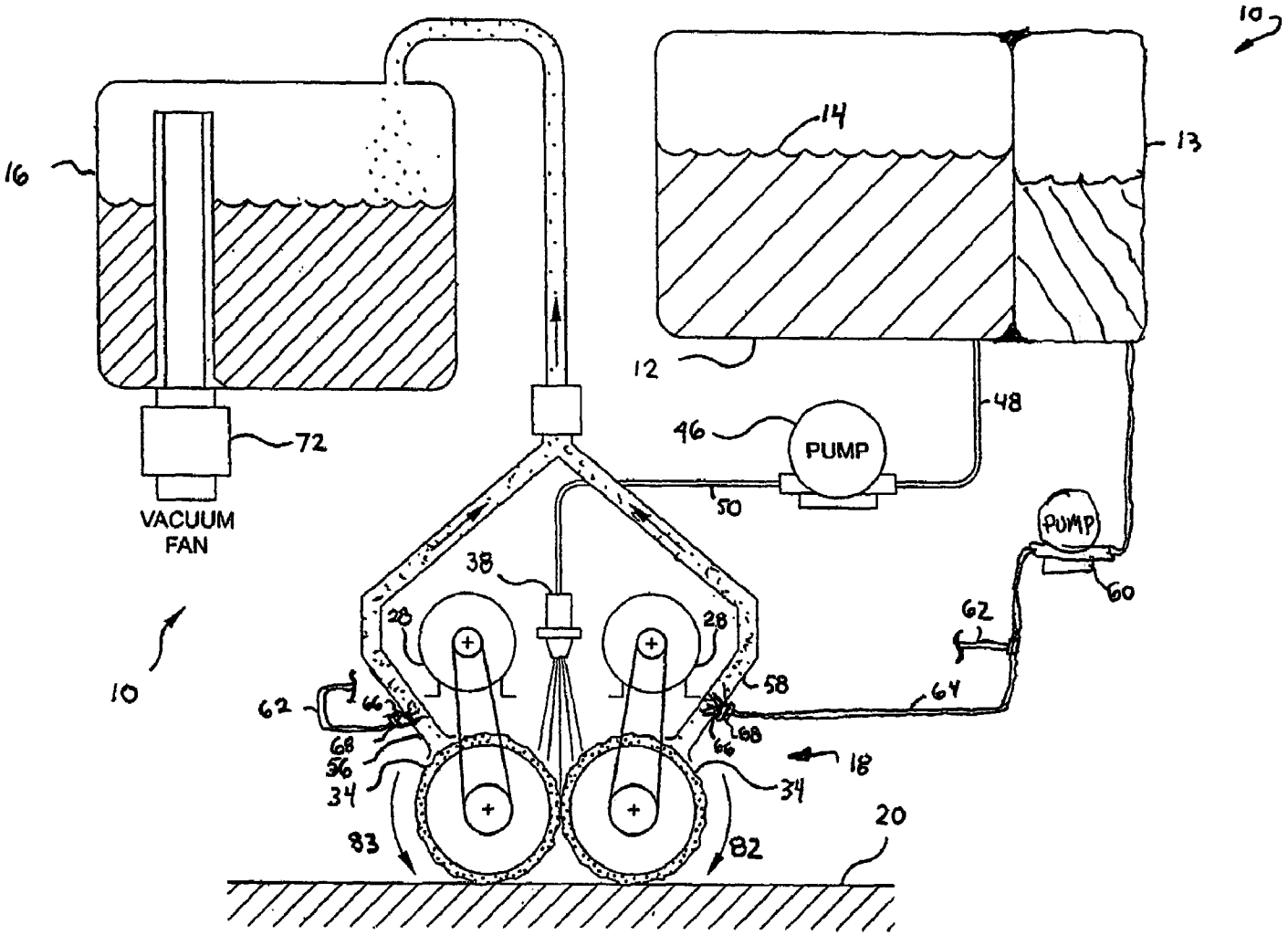
FIG. 2 is a diagrammatic illustration of the embodiment of FIG. 1.

Referring to FIG. 2, cleaning head 18 includes a cleaning medium and associated drive assembly. Drive assembly includes drive motors 28 and belts to rotate the cleaning medium relative to cleaning head 18 and surface 20. In the illustrated embodiment, the cleaning medium includes a pair of soil transfer rolls 34 for use in a soil transfer roll mode of operation.

Cleaning head 18 further includes a spray nozzle 38 for spraying cleaning solution 14 on the soil transfer rolls 34 and/or floor surface 20. The discharge of solution through spray nozzle 38 is controlled by activation of one or more valves (not shown). A fluid pump 46 is provided to pressurize cleaning solution 14.

A cleaning solution dispensing system includes pump 46 for selectively pumping cleaning liquid 14 through conduits 48, 50 and nozzle 38 thereby delivering cleaning liquid 14 to soil transfer rolls 34. Appropriate fluid controls, such as valves (not shown), are provided to control the application of cleaning fluid 14. As depicted in FIG. 2, roll spray nozzle 38 discharges cleaning solution 14 to soil transfer rolls 34 during a soil transfer roll mode of operation. Alternative dispensing means may include drip bars or gravity feed techniques, transfer rolls, etc.

Cleaning head 18 further includes a plurality of vacuum extraction tools 56, 58 for removing soil solution from soil transfer rolls 34. Extractors 56, 58 each include an elongated slot and an outlet aperture. Extractors 56, 58 are configured to remove soiled solution from soil transfer rolls 34. Extractors 56, 58 are sized in relation to soil transfer rolls 34 to remove soiled solution across substantially the entire transverse length of the rolls 34.

A secondary fluid introduction system includes a pump 60 for transferring a fluid from tank 13 through conduits 62, 64 and through ports 66 receiving nozzles 68 directly into the vacuum extractors 56, 58. A valve may control the flow of fluid into extractors 56, 58. The valve may be controlled via a machine controller, or may be manually activated. Tank 13 contains a fluid such as tap water or a cleaning solution. Tank 13 is optional. In another embodiment illustrated in FIG. 3, cleaning solution from cleaning solution tank 12 is introduced directly into the vacuum extractors 56, 58 in accordance with the present invention. In yet another embodiment in FIG. 6, soiled cleaning solution is recycled and reintroduced directly into vacuum extractors 56, 58. Dirty water from soiled solution recovery tank 16 may be coarsely filtered prior to reintroduction in the vacuum extractor tools 56, 58.

Soil transfer rolls 34 may be of a variety of different materials. A combination of pad-like or bristle-like or foam-like materials, and the like, may be used. In a preferred embodiment a material such as a woven synthetic fabric, having pile fibers tufted thereunto is utilized. In one embodiment of the invention, the substrate has an appearance and feel that is similar to the surface fabric used on a common paint roller. In some instances, it may be desirable to intersperse stiffer fibers, i.e., brush-like bristles, into the substrate to enhance the agitation action of soil transfer rolls 34.

In operation, machine 10 is propelled across surface 20. To initiate a cleaning operation, appropriate controls 70, such as switches, are used to activate vacuum fan 72, motors 28, valves, cleaning liquid pump 46, etc. An electronic controller 80 may be utilized to implement machine 10 control. Soil transfer rolls 34 are wetted with cleaning liquid 14 by cleaning solution nozzle 38, then extracted by operation of roll extractors 56, 58 to remove soiled cleaning liquid, and then wiped against floor surface 20 so as to transfer soil from surface 20 onto soil transfer rolls 34. Soil transfer rolls 34 revolve by operation of motors 28 in directions as indicated by arrows 82, 83 so that different portions of the soil transfer rolls 34 are being wetted with cleaning liquid 14, extracted by roll extractors 56, 58, or wiped against surface 20. Cleaning solution is pressurized via pump 46 and flows through a valve and conduit 50 toward roll nozzle(s) 38.

Vacuum extractors 56, 58 each engage a roll 34 to remove some of the just deposited cleaning liquid 14 and soil previously transferred from the carpet surface 20. Each roll 34 is engaged by its associated vacuum extractor 56, 58 to reduce the local wetness of the roll 34. As a result, rotating rolls 34 have a wetted portion, and a reduced wetness portion which engages the carpet surface 20. As rolls 34 are revolved, reduced wetness portions engage the carpet fibers and cause soil to be transferred from the carpet fibers to rolls 34. As rolls 34 are further rotated, the reduced wetness portions (having received soil from the carpet) are sprayed with cleaning liquid 14 by nozzle 38 and subsequently vacuum extracted by extractors 56, 58 to convey soiled cleaning liquid from rolls 34 into soiled solution recovery tank 16.

The soil transfer roll cleaning process thus includes the steps of wetting a portion of rolls 34 with cleaning liquid 14, reducing the relative wetness of the wetted portion of the rolls 34 by extraction, and wiping the surface with the rolls 34 so as to transfer soil from the surface to the rolls 34. Soil upon the rolls 34 is subsequently removed as the revolving rolls 34 are rewetted and extracted. In turn, the soil transfer roll cleaning process repeats as a cycle with rolls 34 revolving so that cleaning liquid 14 is applied to one portion, extractors 56, 58 reduce the relative wetness of another portion of rolls 34 (and removing sailed solution therefrom), and yet another portion of rolls 34 wipe the surface 20 to transfer soil from the surface to the rolls 34.

In operation of the machine, a secondary fluid is introduced into the vacuum extractors 56, 58 in order to minimize the accumulation of soil and debris therewithin. The secondary fluid is sprayed through nozzles 68 into the vacuum extractors 56, 58. Fluid flow through nozzles 68 may be continuous or intermittent. Secondary fluid flow into vacuum extractors 56, 58 may be a mist or a stream. In another embodiment, fluid flow may simply be via a gravity flow system with the secondary fluid dripping into the vacuum extractors 56, 58. In yet another embodiment, no pump 60 would be required and the fluid would be pulled from its source by vacuum action. Secondary fluid flow may be pulsed or slowly transitioning. The control of secondary fluid flow can be facilitated with the machine controller or a separate controller. Secondary fluid flow may be variable, e.g., different flow rates of fluid flow. One or more sensors may be utilized in the control of secondary fluid. For example, an optical sensor may be used to monitor the degree of soil and debris accumulation within the extractor or other vacuum system component in order to trigger the introduction of secondary fluid.

Figure 3:
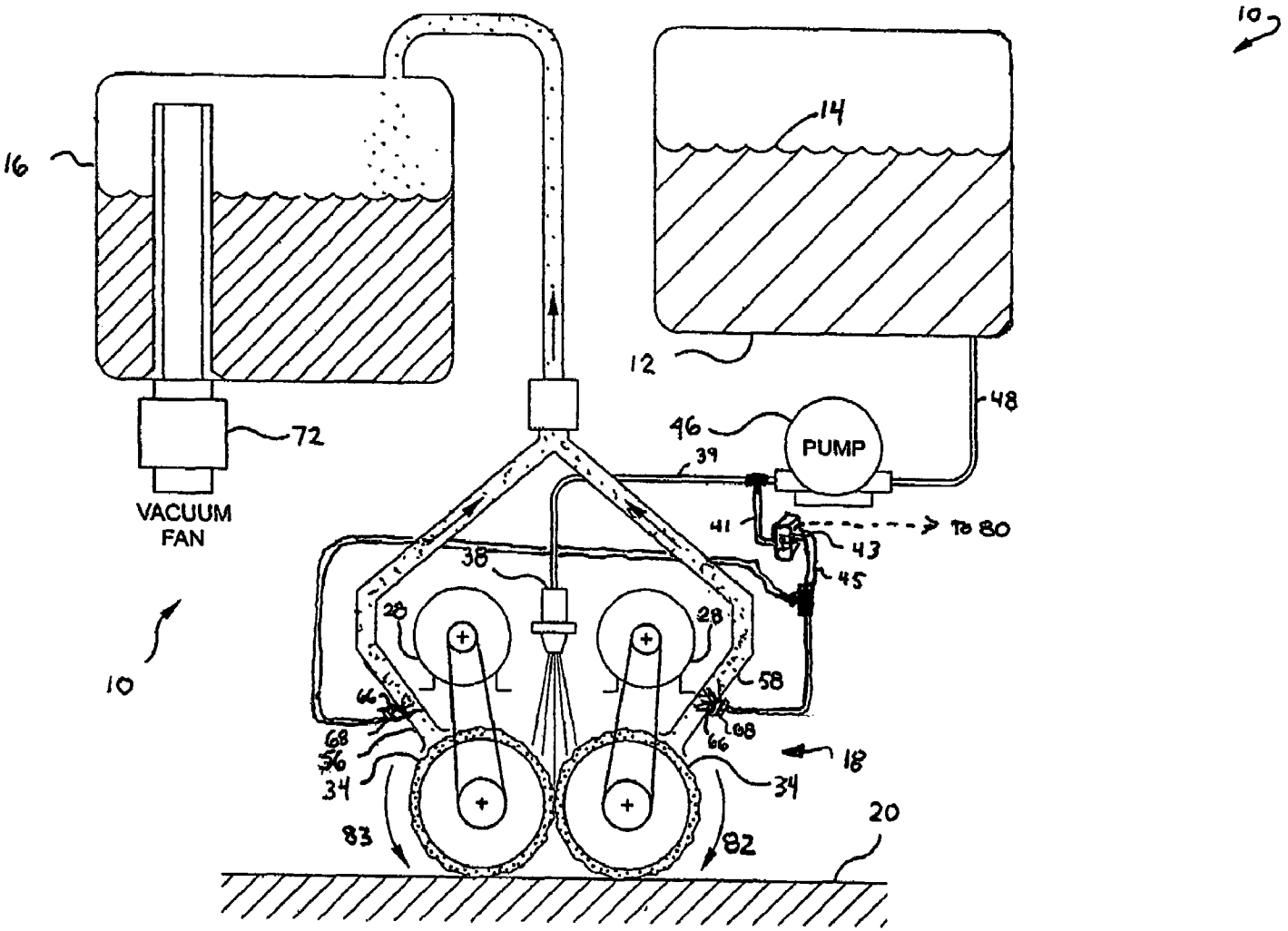
FIG. 3 is a diagrammatic illustration of another embodiment of the present invention.

FIG. 3 illustrates another embodiment of the present invention. A single cleaning solution tank 12 is the source of cleaning fluid for roll nozzle 38 and the extractor head nozzles 68. In comparison to the embodiment of FIG. 2, a single pump 46 is provided in this embodiment to pressurize cleaning solution 14 from tank 12. Cleaning solution 14 is water without detergent. Pump 46 output is coupled to nozzle 38 via line 39 and to valve 43 via line 41. Valve 43 is an electrical valve controlled by controller 80 to intermittently open to provide cleaning fluid 14 to nozzles 68 through line 45.

Figure 4:
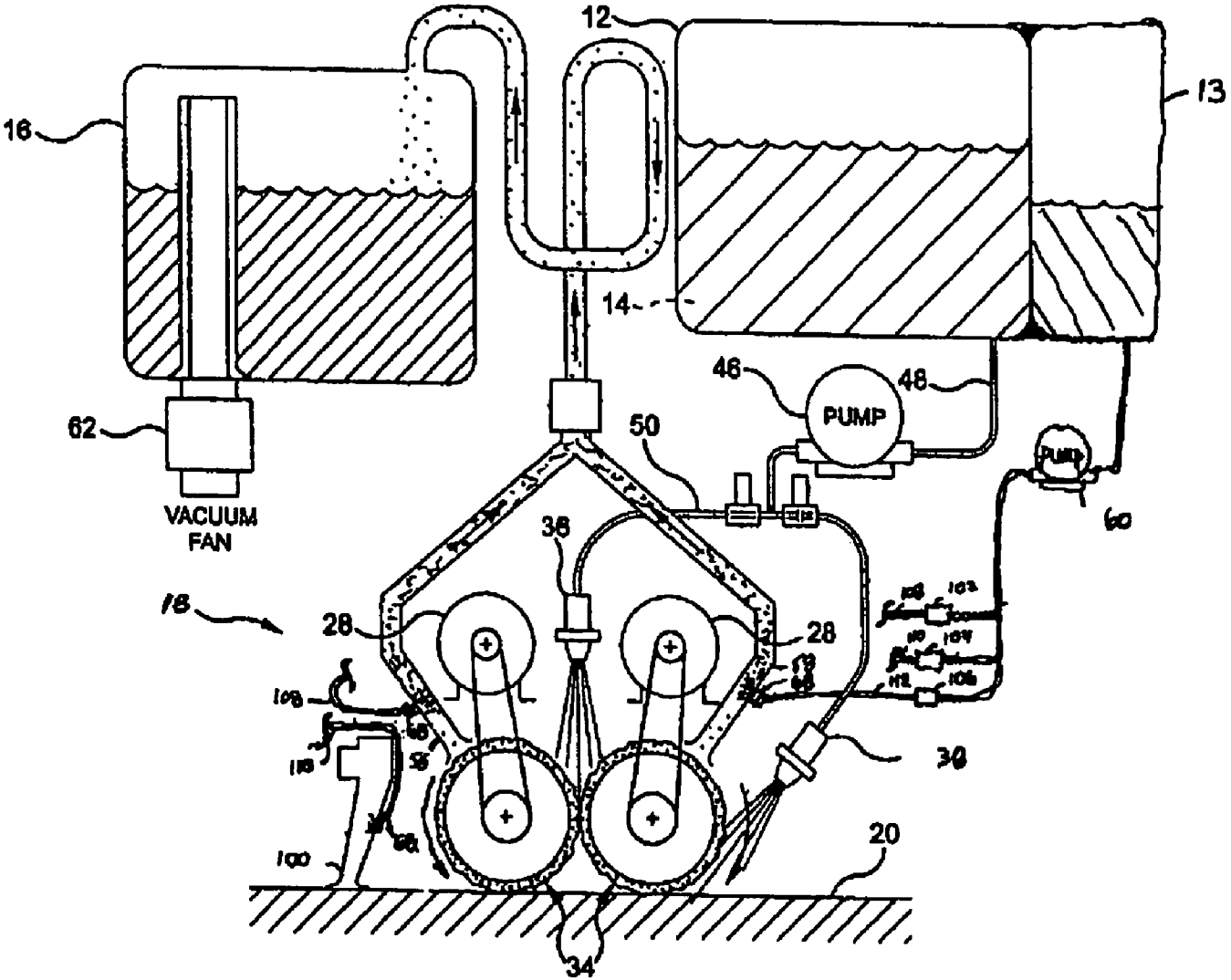
FIG. 4 is a diagrammatic illustration of another embodiment of the present invention.

FIG. 4 illustrates another embodiment of the present invention. This embodiment is a dual mode cleaning apparatus such as disclosed in U.S. Ser. No. 10/371,940. Additional features of this machine include a carpet extractor 100 which directly engages the carpet surface. Carpet extractor 100 may be selectively connected to the vacuum system in order to remove fluid from the carpet surface 20. Similar to the above embodiment, pump 60 is used to pressurize a secondary fluid from fluid tank 13. Pump 60 may be manually controlled by the operator or may be controlled by the machine's electronic controller. Valves 102, 104, 106 are used to control fluid flow through respective fluid lines 108, 110, 112. Secondary fluid may be periodically introduced through one or more fluid lines 108, 110, 112 into associated vacuum extractors 56, 58, 100.

Figure 5:
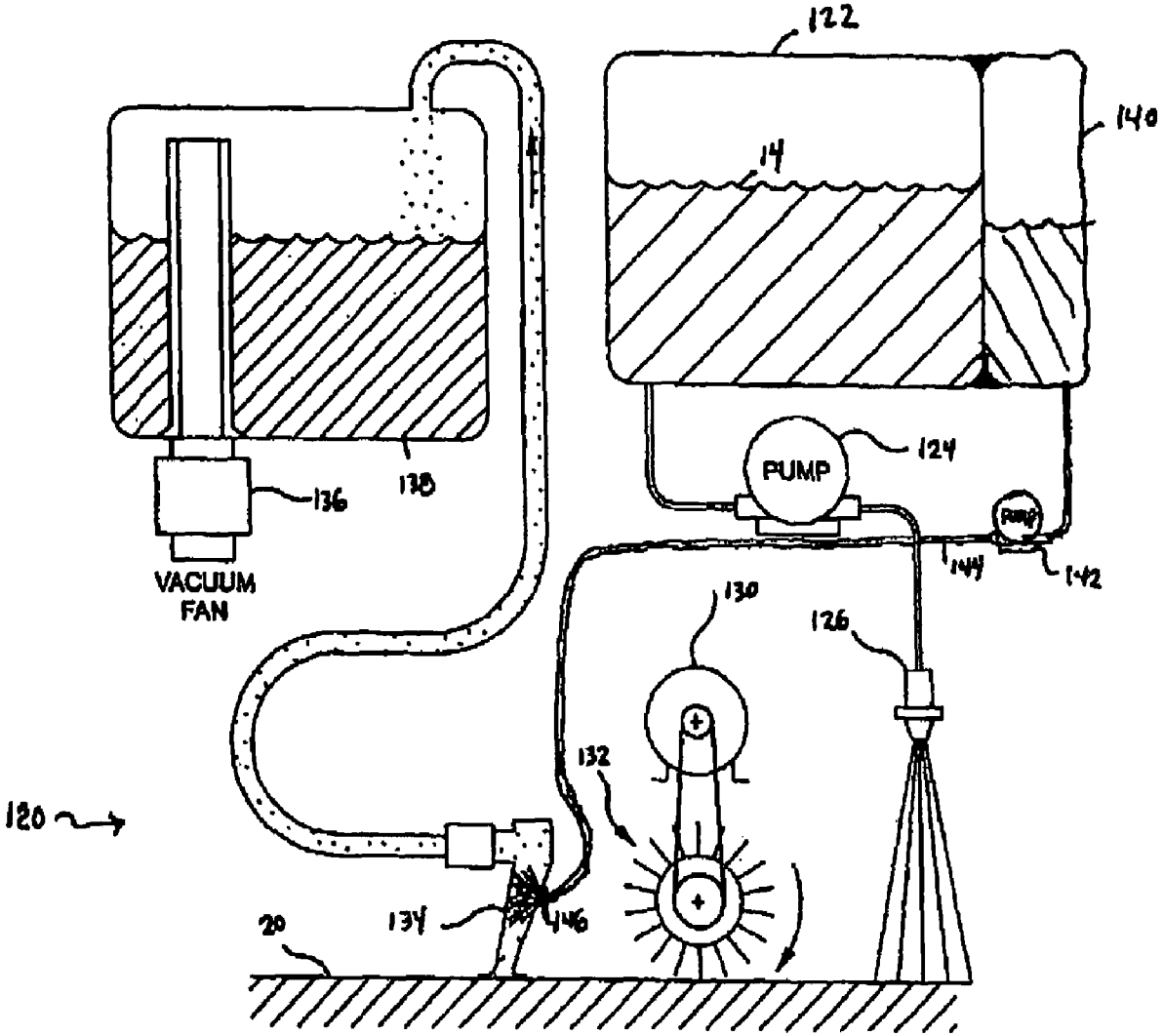
FIG. 5 is a diagrammatic illustration of a conventional carpet extractor improved in accordance with aspects of the present invention.

FIG. 5 illustrates yet another embodiment of the present invention. In general, a conventional extractor machine 120 is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Components of a conventional extractor machine 120 include a solution tank 122, a pump 124 for conveying solution from tank 122, and a spray nozzle 126 for spraying solution onto a floor surface. A brush motor 130 powers a brush 132 which engages the floor surface. Subsequently, as the machine is moved in an operational direction, a pickup tool or "extractor" 134 engages the floor surface to remove soiled solution from the surface. A vacuum fan 136 and recovery tank 138 are provided to respectively remove and receive soiled solution from surface. Additional features of an extractor machine are disclosed in U.S. Pat. No. 4,956,891, assigned to Tennant Company, and incorporated herein by reference.

A secondary fluid tank 140 and fluid pump 142 are provided. Fluid is conducted through conduit 144 and nozzle 146 and into vacuum extractor 134. Similar to the embodiments described above, fluid flow may be manually or automatically controlled to minimize the accumulation of debris and soil with the vacuum system.

Figure 6:
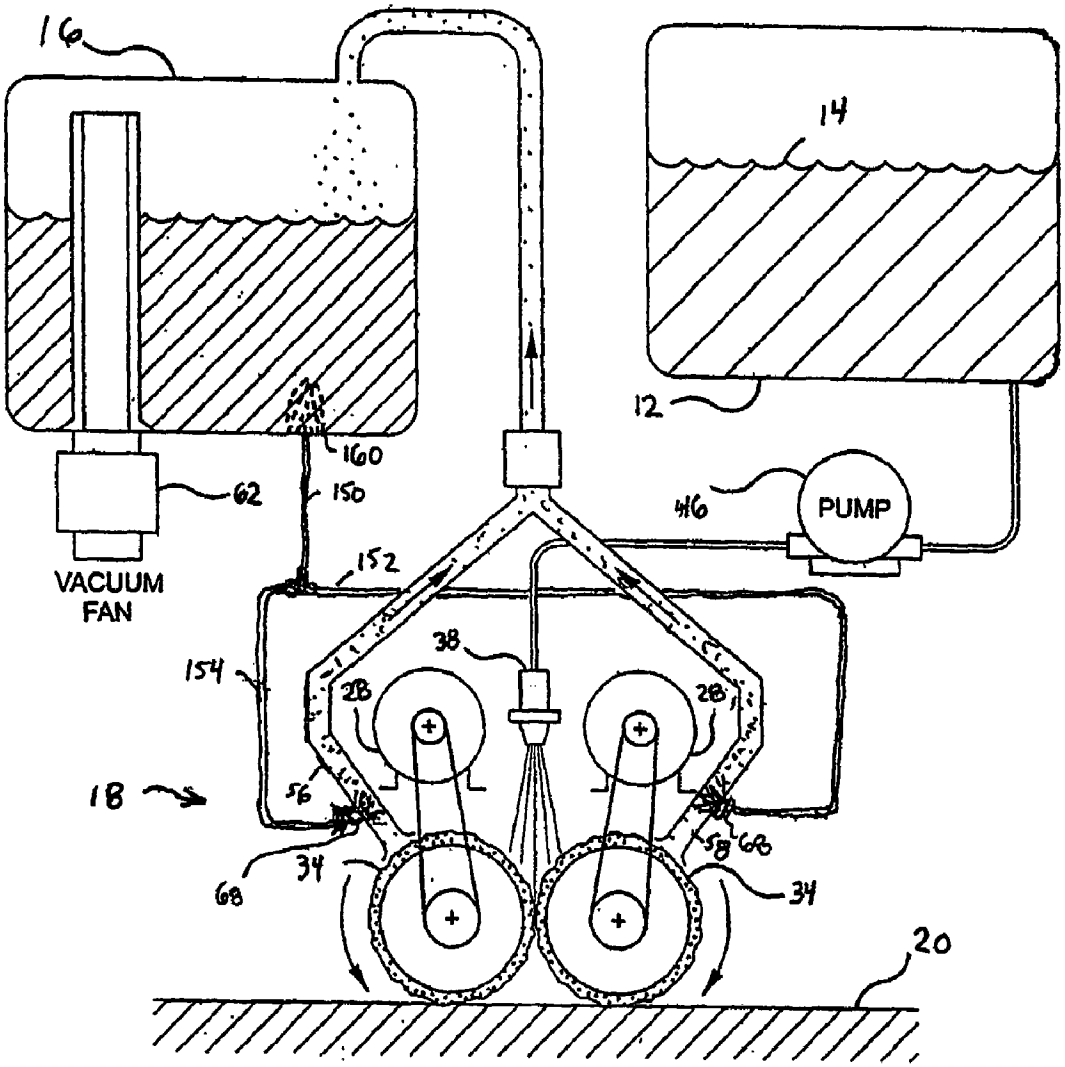
FIG. 6 is a diagrammatic illustration of another embodiment of the present invention wherein soiled cleaning solution is recycled through the vacuum extractor tool.

FIG. 6 illustrates another embodiment of the invention wherein soiled cleaning solution is recycled into use. Recycled cleaning solution may be gravity fed from soiled solution tank 16 through conduits 150, 152, 154. Alternatively, cleaning solution may be pumped via a pump through conduits 150, 152, 154. Recycled cleaning solution may be cleaned via filter 160 prior to reuse. One or more fluid valves may control the flow of recycled fluid through conduits 150, 152, 154.

Figure 7:
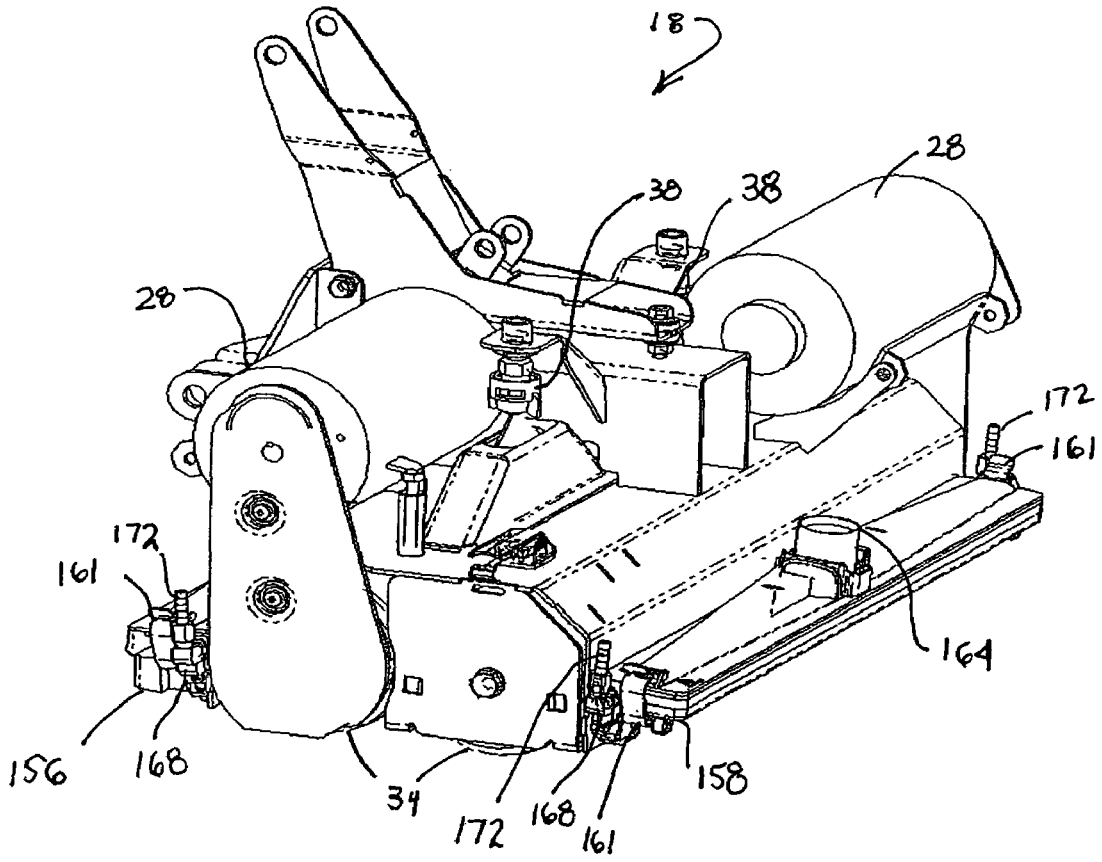
FIG. 7 is perspective illustration of a cleaning head of a cleaning device according to aspects of the present invention.
Figure 8:
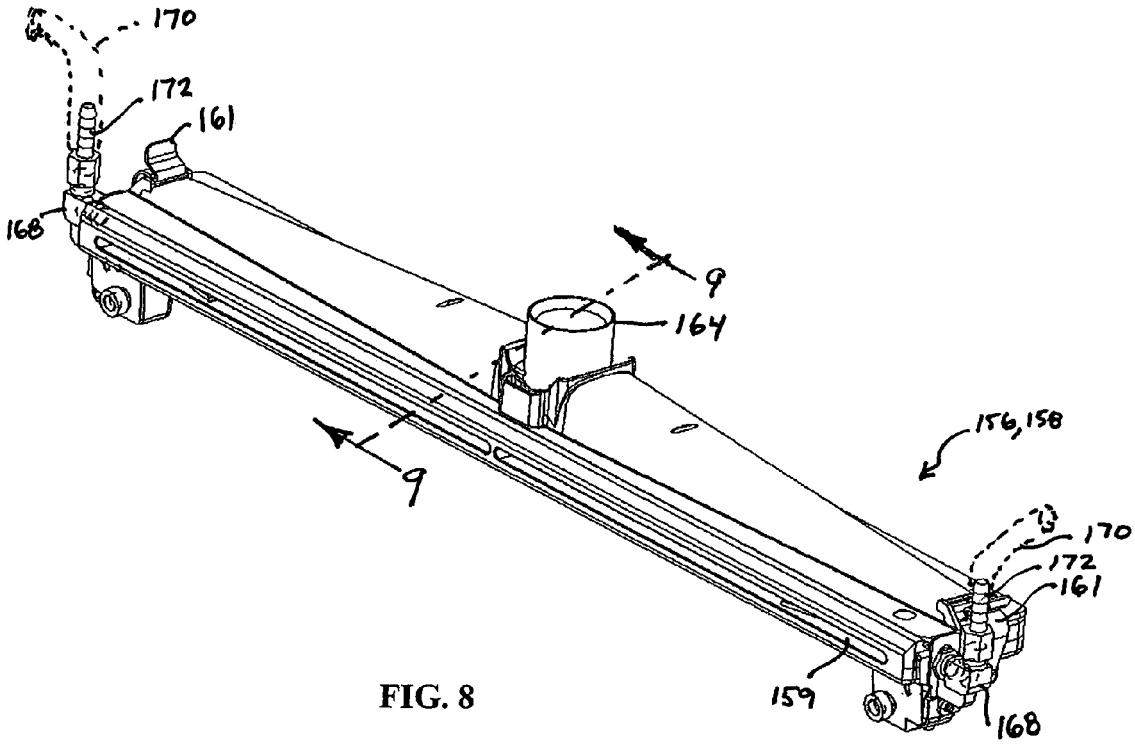
FIG. 8 is a perspective illustration of a vacuum extractor tool of the cleaning head in FIG. 7.
Figure 9:
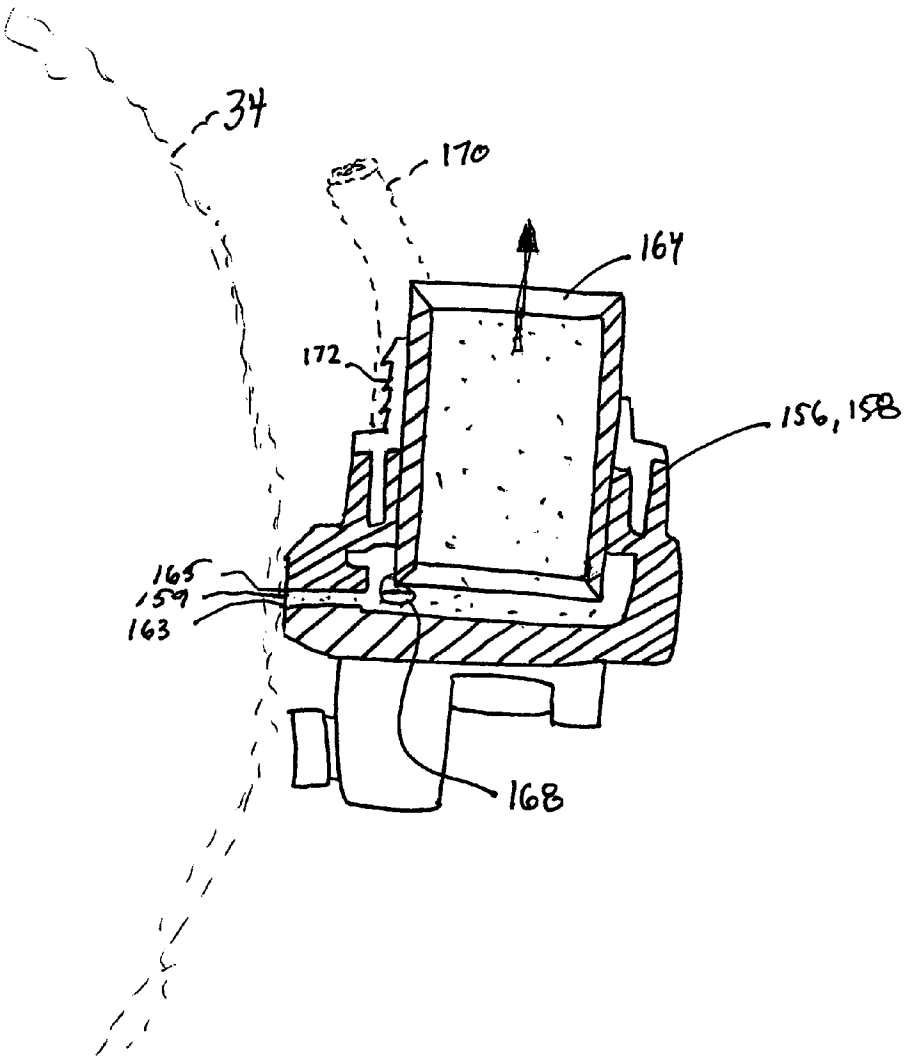
FIG. 9 is a cross sectional view of the vacuum extractor tool of FIG. 8 taken along lines 9-9.

FIG. 7 illustrates cleaning head 18 of another embodiment of the invention. Cleaning head 18 includes a pair of extractors 156, 158. FIG. 8 is a perspective view of extractor 156, 158. FIG. 9 provides a cross-sectional view of extractor 156, 158 taken along lines 9-9. Extractors 156, 158 include an elongated inlet slot 159 in operative engagement with soil transfer rolls 34 and a vacuum outlet 164. Extractors 156, 158 include an upper half and a lower half secured together via a pair of latches 161. Release of latches 161 permits access into the interior of extractors 156, 158 for purposes such as inspection and cleaning. Additional details of similar extractors are disclosed in commonly-assigned U.S. patent application Ser. No. 10/236,746, entitled "Low Profile Head," filed Sep. 6, 2002. A spray nozzle 168 is connected at each side of extractor 156, 158. Nozzles 168 are connected to fluid lines 170 through a barbed fitting 172. Nozzles 168 spray secondary fluid into the interior of extractors 156, 158. The spray pattern of nozzles 168 is preferably fan-shaped, with a plane containing the fan spray pattern being generally parallel to bottom of extractor 156, 158. When so aligned, the fan spray pattern engages surfaces 163, 165 adjacent inlet slot 159. The fan spray from nozzle 168 dislodges debris and soil from interior surfaces of extractor 156, 158 and directs debris and soil toward central vacuum outlet 164. In a preferred embodiment, the secondary fluid is intermittently sprayed into the interior of extractors 156, 158 as controlled by the device's electronic controller 80.

Additional aspects of the present invention will be addressed. It is envisioned that the method and apparatus according to the present invention may be performed on a variety of different machines, ranging from small manually operated devices, to large operator driven vehicles. The illustrated device is a walk-behind type cleaning machine, more particularly a battery powered self-propelled machine. In alternative embodiments, machine 10 may be propelled by an operator or may include a vehicle, such as a ride-on or towed-behind vehicle. Machine 10 may be powered through battery power, as shown, through alternating current supplied through a cord, or through another type of on-board power source, such as an IC engine.

Extractor tools 56, 58, 156, 158 may be provided by a wide array of structures and techniques as may be appreciated by those skilled in the relevant arts. One particular extractor technology is disclosed in U.S. application Ser. No. 10/236,746, entitled "Fluid Recovery Device", assigned to Tennant Company, and incorporated in its entirety herein by reference.

Secondary fluid flow into the vacuum extractors 56, 58, 156, 158 may be via a plurality of nozzles. For example, three nozzles may spray fluid into each vacuum extractor. A single pump may be utilized to pressurize both the cleaning solution and the secondary fluid with appropriate devices controlling the flow of fluid either to the soil transfer rolls 34 or into the vacuum extractors 56, 58, 156, 158.

Figure 10:
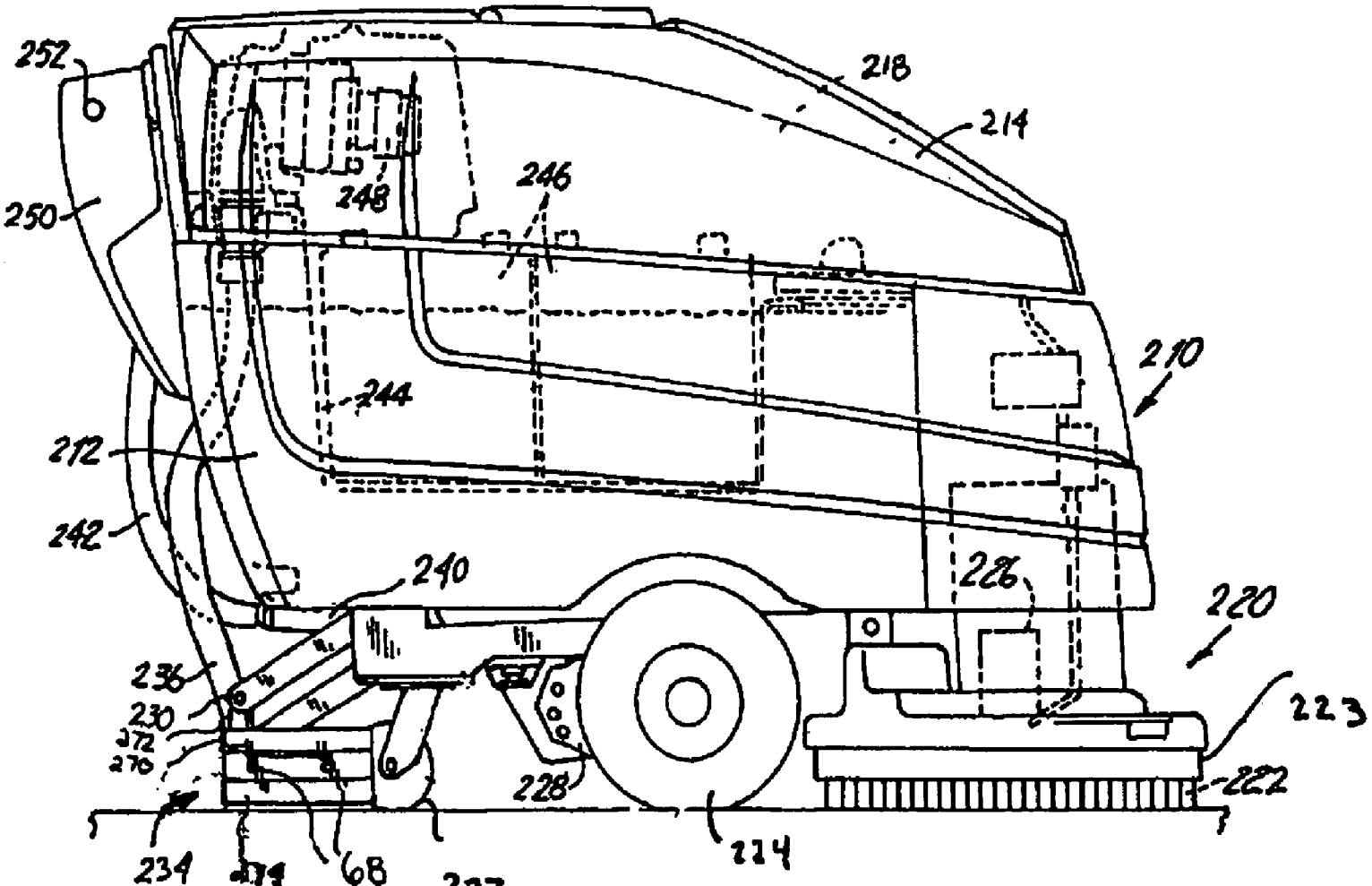
FIG. 10 is a side view of another embodiment of a cleaning machine incorporating aspects of the present invention.

FIG. 10 illustrates an embodiment of a surface maintenance vehicle incorporating aspects of the present invention. The illustrated surface maintenance vehicle is a walk-behind scrubber machine 210 utilized to clean hard floor surfaces, such as concrete, tile, vinyl, terrazzo, etc. One type of scrubber machine is disclosed in U.S. Pat. No. 6,705,332, entitled "Hard Floor Surface Cleaner Utilizing an Aerated Cleaning Liquid," and incorporated by reference herein. In alternative embodiments, the surface maintenance vehicle may be a ride-on or towed-behind vehicle performing a scrubbing operation as described herein. The surface maintenance vehicle may be powered through an on-board power source, such as batteries or an IC engine, or though an electrical cord. In the embodiment of FIG. 10, the scrubber 210 includes a recovery tank 212, a lid 214 and a front cover 216. The lid 214 is attached along one side of the recovery tank by hinges (not shown) so the lid 214 can be pivoted up to provide access to the interior of the tank 212. The lid 214 defines a cleaning solution tank 218 for containing a cleaning liquid, such as a mixture of water and a cleaning chemical to be conditioned, applied to the hard floor surface, and recovered from the floor surface.

A scrub head 220 includes a scrubbing medium 222, shrouds 223, and a scrubbing medium drive 226. The scrubbing medium 222 may be one or more brushes. In the illustrated embodiment, a pair of brushes 222 define the scrubbing medium. The brushes 222 may include bristle brushes, pad scrubbers, or other hard floor surface engaging devices for scrubbing. One or more electric motor brush drives 226 may be utilized to rotate the brushes 222. The scrubbing medium may be a disk-type scrub brush rotating about a generally vertical axis of rotation relative to the hard floor surface. In other embodiments, the scrubbing medium may be a cylindrical-type scrub brush rotating about a generally horizontal axis of rotation relative to the hard floor surface. Alternative embodiments scrub brushes 222 may be oscillated rather than rotated into contact with the hard floor surface. The scrub head 220 is attached to the machine 210 such that the scrub head 220 can be moved between a lowered working position mid a raised traveling position.

A machine frame supports the recovery tank 128 on wheels 224 and casters 227. Further details of the frame are shown and described in U.S. Pat. No. 5,611,105 the disclosure of which is incorporated herein by reference. Wheels 224 are preferably driven by a motor and transaxie assembly shown schematically at 228. The rear of the frame carries a linkage 230 to which a vacuum squeegee 234 is attached.

Vacuum squeegee 234 may be considered another type of vacuum extractor tool. Vacuum squeegee 234 is in vacuum communication with an inlet chamber in the recovery tank 212 through a hose 236. Vacuum squeegee 234 includes a frame 270, a vacuum outlet 272 and a pair of deformable squeegee members 274 together defining an interior region. Further aspects of a vacuum squeegee are disclosed in co-pending and commonly assigned U.S. application Ser. No. 10/177,365 entitled "Squeegee with Clog Reduction Structure," and incorporated by reference herein. The bottom of the inlet chamber is provided with a drain 240 with a drain hose 242 connected to it The vehicle body incorporates a battery compartment 244 in which batteries 246 reside, as shown in FIG. 10. The batteries 246 provide power to the drive motors 226, scrub head 220, and a vacuum fan 248. The vacuum fan 248 is mounted in the lid 214. A control unit 250 mounted on the rear of the body includes steering control handles 252 and the necessary operating controls and gauges for the scrubber. Additional aspects of automatic scrubber machines are disclosed in U.S. Pat. Nos. 5,483,718; 5,515,568; and 5,566,422, each incorporated by reference herein.

A plurality of secondary fluid nozzles 68 are connected to vacuum squeegee 234. As shown, nozzles 68 are provided along a rear side of squeegee 234. However, in alternative embodiments nozzles 68 may be disposed at a top side or front side of squeegee 234. As described above, nozzles 68 are connected to a pump for pressurizing a fluid to be sprayed into the interior of the vacuum squeegee 234. Nozzle spray acts to dislodge accumulations of debris and soil from within the vacuum squeegee 234 and/or vacuum conduit 236. Nozzle spray may be directed toward the vacuum outlet 272 so that debris dislodged from within the squeegee interior is mechanically transported toward the vacuum outlet 272. As described with reference to other embodiments of the invention, nozzle spay may be controlled by control unit 250.

As various changes could be made in the above methods and devices without departing from the scope of the invention, it is intended that all matter contained in the above description or shown in the accompanying drawings shall be interpreted as illustrative and not in a limiting sense.

We claim:

1. A surface maintenance device for performing a surface cleaning processes, comprising:

a revolving cleaning implement which wipingly engages a surface intended to be cleaned;

a cleaning solution dispenser which selectively wets with a cleaning solution the cleaning implement or the surface intended to be cleaned or both;

a vacuum extractor tool in engagement with the cleaning implement or the surface, wherein said vacuum extractor tool removes some soiled cleaning solution from the revolving cleaning implement or the surface; and a fluid port in the vacuum extractor tool through which a secondary fluid is introduced in order to minimize the accumulation of soil and debris within the vacuum extractor tool.

2. The surface maintenance device of claim 1 wherein the secondary fluid is a cleaning solution.

3. The surface maintenance device of claim 2 wherein the cleaning solution and secondary fluid are both tap water.

4. The surface maintenance device of claim 1 further comprising:

a cleaning solution tank; and a separate secondary fluid tank.

5. The surface maintenance device of claim 1 further comprising:

a nozzle in fluid communication with the fluid port, said nozzle for spraying fluid into the vacuum extractor tool.

6. The surface maintenance device of claim 5 wherein the secondary fluid is pressurized by a pump and sprayed into the vacuum extractor tool.

7. The surface maintenance device of claim 1 wherein flow of the secondary fluid is automatically controlled by an electronic controller of the device.

8. The surface maintenance device of claim 7 wherein a flow rate of secondary fluid into the vacuum extractor tool is variable.

9. The surface maintenance device of claim 1 further comprising:

a floor vacuum extractor tool for engaging a carpet surface; and a fluid port in the floor vacuum extractor tool through which the secondary fluid is introduced to minimize the accumulation of soil and debris within the floor vacuum extractor tool.

10. The surface maintenance device of claim 1 wherein a nozzle is disposed at the fluid port proximate to a lateral side portion of the vacuum extractor tool.

11. The surface maintenance device of claim 10 wherein the nozzle has a fan-shaped spray pattern and secondary fluid spray contacts interior surfaces of the vacuum extractor tool which are adjacent an inlet slot of the vacuum extractor tool.

12. A surface maintenance device comprising:

a cleaning implement in selective contact with a surface to be cleaned;

a cleaning solution dispenser which selectively distributes a cleaning solution to the cleaning implement or a portion of the surface or both;

a vacuum extractor tool which removes some of the dispensed cleaning solution and soil from the cleaning implement or the surface or both; and a secondary fluid conduit for conveying a fluid directly into the vacuum extractor tool during a soil accumulation reduction condition of device operation.

13. The surface maintenance device of claim 12 wherein cleaning implement is a soil transfer roll.

14. The surface maintenance device of claim 12 wherein the cleaning implement is a bristle brush in contact with the surface to be cleaned.

15. The surface maintenance device of claim 12 further comprising:

a fluid port in the vacuum extractor tool through which the fluid flows.

16. The surface maintenance device of claim 12 further comprising:

a pump for conveying the fluid.

17. The surface maintenance device of claim 12 wherein the soil accumulation reduction condition is continuous during operation of the device.

18. The surface maintenance device of claim 12 wherein the soil accumulation reduction condition is intermittent during operation of the device.

19. The surface maintenance device of claim 18 wherein the soil accumulation reduction condition is controlled by an operator or by an electronic controller of the device.

20. The surface maintenance device of claim 12 wherein fluid is a secondary fluid different from the cleaning solution and held within a separate secondary fluid tank.

21. The surface maintenance device of claim 12 wherein the fluid introduced directly into the vacuum extractor tool is a cleaning fluid or recycled soiled cleaning solution.

22. The surface maintenance device of claim 12 wherein the secondary fluid conduit connects to a spray nozzle at a side lateral portion of the vacuum extractor tool, said spray nozzle for spraying the secondary fluid into an interior of the vacuum extractor tool.

23. A surface maintenance device for performing a surface cleaning process comprising:

a cleaning implement which engages a surface intended to be cleaned;

a cleaning solution dispenser which selectively wets with a cleaning solution the cleaning implement or the surface intended to be cleaned or both;

a vacuum extractor tool in engagement with the cleaning implement or the surface, wherein said vacuum extractor tool removes some soiled cleaning solution from the cleaning implement or the surface; and a fluid port in the vacuum extractor tool through which a pressurized secondary fluid is introduced in order to mechanically dislodge an accumulation of soil and debris within the vacuum extractor tool by spray action.

24. A surface maintenance device for performing a surface cleaning process comprising:

a cleaning implement which engages a surface intended to be cleaned;

a cleaning solution dispenser which selectively wets with a cleaning solution the cleaning implement or the surface intended to be cleaned or both;

a vacuum extractor tool in engagement with the cleaning implement or the surface, wherein said vacuum extractor tool removes some soiled cleaning solution from the cleaning implement or the surface or both; and a pair of fluid ports in the vacuum extractor tool through which a secondary fluid is sprayed in order to mechanically dislodge and direct an accumulation of soil and debris within the vacuum extractor tool by spray action toward a vacuum outlet located between the pair of fluid ports.

25. A surface maintenance device comprising:

a source of fluid;

a vacuum fan;

a vacuum hose in fluid communication with the vacuum fan;

a vacuum extractor tool connected at an outlet port to the vacuum hose and having an elongated inlet slot in operative engagement with a surface for removing cleaning solution therefrom; and a nozzle spraying pressurized fluid from the source directly at interior surfaces of the vacuum extractor tool so as to mechanically dislodge debris therefrom wherein the nozzle spray directs fluid and debris toward the outlet port of the vacuum extractor tool.

26. The surface maintenance device of claim 25 wherein the surface is a carpet surface.

27. The surface maintenance device of claim 25 wherein the surface is a portion of a revolving cleaning medium.

28. The surface maintenance device of claim 25 wherein the surface is a hard floor surface and the vacuum extractor tool is a vacuum squeegee having a pair of flexible squeegee elements.

29. The surface maintenance device of claim 25 wherein the nozzle provides a fan-shaped spray pattern.

30. The surface maintenance device of claim 29 wherein the fan-shaped spray pattern is aligned relative to an inlet slot of the vacuum extractor tool so as to dislodge debris from surfaces near the inlet slot.

31. A surface maintenance device comprising:

a source of fluid;

a vacuum fan;

a vacuum hose in fluid communication with the vacuum fan;

a vacuum extractor tool having a bottom portion and a top portion, said top and bottom portions being separable so as to provide access to an interior of the vacuum extractor tool, said top portion defining an outlet port which is in fluid communication with the vacuum hose, said vacuum extractor tool having an elongated inlet slot in operative engagement with a surface for removing cleaning fluid therefrom; and a nozzle spraying pressurized fluid from the source directly at the interior surfaces of the vacuum extractor tool so as to mechanically dislodge debris therefrom, wherein nozzle spray is directed toward the outlet port of the vacuum extractor tool so as to mechanically transport dislodged debris toward the outlet port.

32. A method of operating a surface maintenance device comprising the steps of providing a cleaning implement in selective contact with a surface to be cleaned, a cleaning solution dispenser which selectively distributes a cleaning solution to the cleaning implement or a portion of the surface or both, a vacuum extractor tool which removes some of the dispensed cleaning solution and soil from the cleaning implement or the surface or both, a fluid conduit in fluid communication with a secondary fluid source and the vacuum extractor tool; and selectively controlling the flow of secondary fluid through the fluid conduit and into the vacuum extractor tool during a soil accumulation reduction condition of device operation.

33. The method of operating a surface maintenance device of claim 32 wherein the step of selectively controlling the flow of secondary fluid is via at least one valve.

34. The method of operating a surface maintenance device of claim 33 wherein the at least one fluid valve is manually operated during device operation in order to control the flow of secondary fluid into the vacuum extractor tool.

35. The method of operating a surface maintenance device of claim 33 wherein the at least one valve is automatically operated during device operation to control the flow of secondary fluid into the vacuum extractor tool.

36. The method of operating a surface maintenance device of claim 33 wherein the vacuum extractor tool is a vacuum squeegee having a frame and a pair of flexible squeegee elements.

* * * * *

UNITED STATES PATENT AND TRADEMARK OFFICE

CERTIFICATE OF CORRECTION

PATENT NO. : 7,272,870 B2
APPLICATION NO. : 10/841872
DATED : September 25, 2007
INVENTOR(S) : Pierce et al.

It is certified that error appears in the above-identified patent and that said Letters Patent is hereby corrected as shown below:

Col. 12
In claim 35, line 2, before "valve" insert --fluid--.

Signed and Sealed this

Eleventh Day of December, 2007

JON W. DUDAS
*Director of the United States Patent and Trademark Office*